US005931594A

United States Patent [19]

Garcia

[11] Patent Number: 5,931,594

[45] Date of Patent: Aug. 3, 1999

[54] COSMETIC PRODUCT DISTRIBUTORS INTENDED FOR MAKE-UP AND CORRESPONDING GRIPPING ELEMENT

[75] Inventor: Firmin Garcia, Evreux, France

[73] Assignee: Valois S.A., Le Neubourg, France

[21] Appl. No.: 08/989,926

[22] Filed: Dec. 12, 1997

[51] Int. Cl.[6] ..... A46B 11/00

[52] U.S. Cl. ..... 401/126; 401/119

[58] Field of Search ..... 401/126, 129, 401/119, 118, 127, 128, 130; 132/218

[56] References Cited

U.S. PATENT DOCUMENTS

| | | | |
|---|---|---|---|
| 2,772,704 | 12/1956 | McConnell et al. | 401/126 |
| 2,926,374 | 3/1960 | Adler | 401/185 |
| 3,400,997 | 9/1968 | Schwartzman | 401/186 |
| 3,655,290 | 4/1972 | Griffith | 401/186 |
| 4,780,017 | 10/1988 | Bradford | 401/129 |
| 5,002,415 | 3/1991 | Gueret . | |
| 5,224,787 | 7/1993 | Vasas | 401/119 |
| 5,332,325 | 7/1994 | Crosnier et al. | 401/119 |
| 5,339,841 | 8/1994 | Gueret . | |

FOREIGN PATENT DOCUMENTS

| | | |
|---|---|---|
| 0 349 416 | 1/1990 | European Pat. Off. . |
| 0 553 021 | 7/1993 | European Pat. Off. . |
| 0 601 192 | 6/1994 | European Pat. Off. . |
| 2 363 299 | 3/1978 | France . |
| 2 685 858 | 7/1993 | France . |
| 2 753 060 | 3/1998 | France . |
| 36 41 389 | 1/1988 | Germany . |
| 37 36 095 | 5/1989 | Germany . |
| 4105294 | 9/1991 | Germany . |
| 9004068 | 9/1991 | Germany . |
| 2242354 | 10/1991 | United Kingdom . |

*Primary Examiner*—David J. Walczak
*Attorney, Agent, or Firm*—Darby & Darby

[57] ABSTRACT

A distributor for a cosmetic product, in fluid or paste form, intended for make-up, in particular for a mascara distributor, includes a distributor body and a gripping element. The distributor body includes a seating for an applicator member, and the gripping element includes a capsule with a rod bearing the applicator member at one of its ends, with the rod projecting from the capsule. The capsule is capable of being assembled in a removable manner on the distributor body, and is capable of being gripped by a user in order to apply the cosmetic product. A reservoir for the cosmetic product is associated with a feeding mechanism for sending successive doses of the cosmetic product from the reservoir. The product reservoir is situated in the capsule, and the rod bearing the applicator member has an internal duct which extends from the base of the rod to the applicator member to communicate with the outlet of the product feeding mechanism disposed in the capsule.

14 Claims, 1 Drawing Sheet

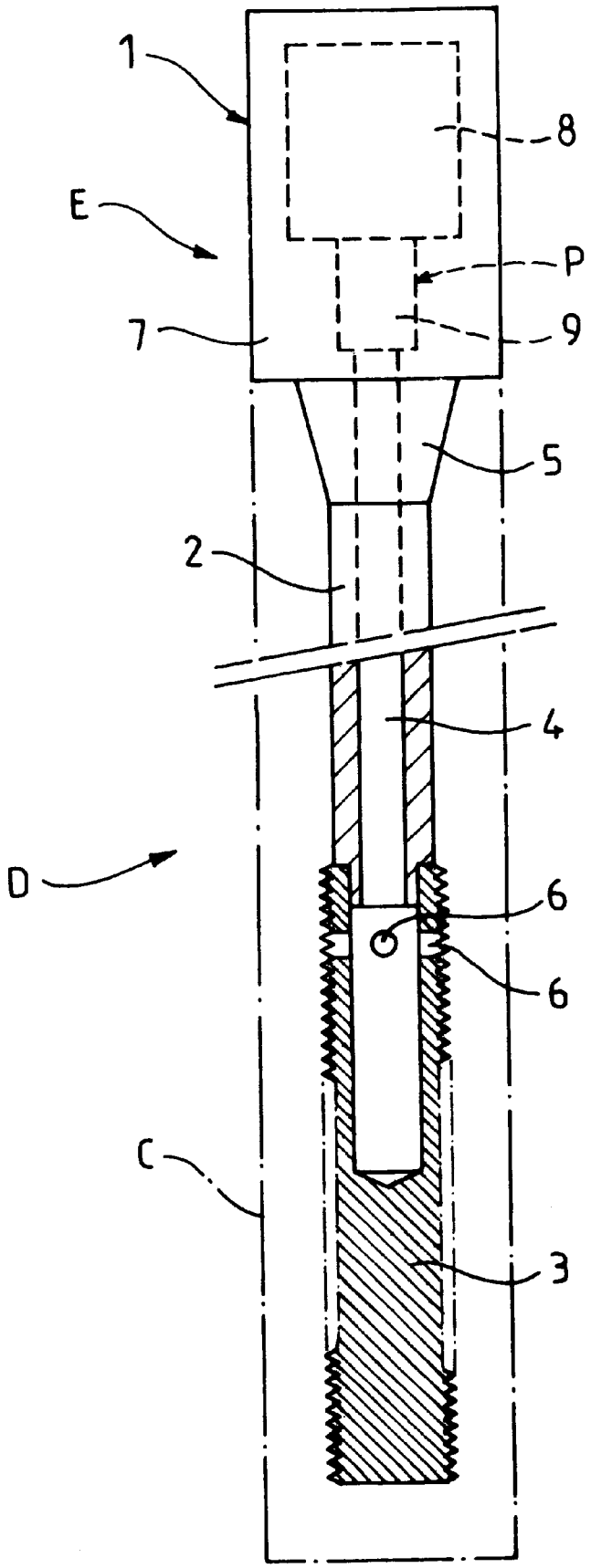
1
8
E
P
7
9
5
2
4
D
6
6
C
3

COSMETIC PRODUCT DISTRIBUTORS INTENDED FOR MAKE-UP AND CORRESPONDING GRIPPING ELEMENT

BACKGROUND OF THE INVENTION

1. Field of the Invention

The invention relates to improvements to tributors of cosmetic product, in fluid or paste form, which is intended for make-up, in particular to mascara distributors, of the type of those comprising a distributor body with a seating for an applicator member, and a gripping element comprising a capsule provided with a rod bearing the applicator member at an end projecting from the capsule, which can be assembled in a removable manner on the distributor body and can be gripped by a user in order to apply the product, a cosmetic product reservoir furthermore being provided together with product feed means to distribute the product from the reservoir.

2. Description of the Prior Art

A cosmetic product distributor of this type is known, in particular from FR-B-2 685 858.

The embodiment shown in FIGS. 2*a* and 2*b* of this prior document shows a distributor in which the body and the gripping element form an entity. The seating for the applicator member provided at one end of the gripping assembly is closed by a lid. The product feed to the applicator member takes place along a complicated path from a reservoir accommodated in the body/gripping element assembly.

SUMMARY OF THE INVENTION

The object of the invention is, in particular, to provide a cosmetic product distributor of the type defined above which allows a product feed to the applicator member which is as direct as possible while keeping the product protected from air to avoid its contamination. It is desirable that the distributor should be simple and economical to manufacture and reliable to use. The gripping element must be easy to manipulate.

According to the invention, a cosmetic product distributor of the type defined above is characterized in that the product reservoir and its associated feed means are situated in the capsule and in that the rod bearing the applicator member possesses an internal duct which extends from the base of the rod, where it communicates with the outlet of feed means, to the applicator member.

The product feed means may comprise a pump, in particular a pump without an air inlet ("airless" pump).

The internal duct, preferably coaxial with the rod, opens at the level of the applicator member through holes which are radially oriented and regularly distributed around the periphery. For example, four holes at an angular offset of 90° are provided to this end.

The outlet holes for the cosmetic product are provided towards the end of the applicator member which first passes through a drier when the gripping element and the body are separated, so that, when the rod is extracted through the drier, the latter ensures the distribution of the product over the entirety of the applicator member.

In the event that the rod is extracted by traction, the outlet holes are provided at the head of the applicator member, that is to say towards the end of this applicator member situated nearer to the base of the rod.

Advantageously, the applicator member is formed by a cylinder, for example of plastic, grooved externally.

The invention likewise relates to a gripping element of a cosmetic product distributor, comprising a capsule provided with a rod bearing an applicator member at an end projecting from the capsule, which can be assembled in a removable manner on a distributor body and can be gripped by a user in order to apply the product, a cosmetic product reservoir furthermore being provided together with product feed means for sending successive doses of product to the applicator member from the reservoir, characterized in that the product reservoir is situated in the capsule and in that the rod bearing the applicator member possesses an internal duct which extends from the base of the rod, where it communicates with the outlet of product feed means likewise arranged in the capsule, to the applicator member.

BRIEF DESCRIPTION OF THE DRAWINGS

The invention, apart from the arrangements set out above, resides in a number of other arrangements which will be discussed in more detail below in connection with a particular example of embodiment described with reference to the attached drawing, which embodiment is however in no way limitative.

FIG. 1 illustrates an axial longitudinal cross-sectional view of the gripping element of a cosmetic product distributor according to the invention.

DESCRIPTION OF THE PREFERRED EMBODIMENT(S)

Referring to FIG. 1, a distributor D is shown for distributing a cosmetic product in fluid or paste form which is intended for make-up, in particular for mascara. This distributor comprises a distributor body C which is shown diagrammatically and a gripping element E comprising a capsule 1 provided with a rod 2 bearing an applicator member 3 at an end projecting from the capsule 1. In the example shown, the applicator member 3 is formed by an externally grooved plastic cylinder. It is to be noted that the term "applicator member" must be understood in a very general sense as encompassing not only the member described but any applicator member of different structure, for example a block of sponge or foam or an externally flocked element.

The rod 2 possesses a coaxial internal duct 4, extending from a base 5 of the rod to the applicator member 3. The channel 4 opens, at the level of this applicator member, through holes 6 which are radially oriented and angularly distributed over the entire periphery of the applicator member. According to the example in the drawing, four holes 6, spaced apart at an angle of 90°, are provided; their number may of course be different. The diameter of the holes 6 is adapted to the viscosity of the product.

The holes 6 are positioned at the head of the applicator member 3, that is to say towards the end of that member situated towards the rod 2 and the base 5, so that, in the case of a drying carried out by withdrawing the rod 2 by a traction movement, the product delivered through the holes 6 is distributed over the entire length of the applicator member 3.

The base 5 is fixed to the end of a cylindrical shell 7 of the capsule. A cosmetic product reservoir 8 is arranged in the shell 7.

Product feed means P, appropriate for supplying successive doses, are arranged in the reservoir and comprise a pump 9, whose outlet orifice is linked to the duct 4.

The ejection of the successive doses of product towards the applicator member 3 is undertaken by the pump 9. This pump 9 may be of the type without air inlet ("airless") or of a different type.

This being the case, the use and manner of operation of the distributor and of the gripping element are as follows.

The user, before making up, causes the ejection of a dose of product, which flows through the duct 4 and passes through the holes 6 to arrive on the applicator member 3.

Making-up then takes place by means of the gripping element E, held by the capsule 1 in which the product reservoir 8 is located.

The feed of doses of product to the applicator member 3 is thus provided via the interior of the rod 2, through the holes 6, which allows the output of a dose which has been bacteriologically protected until it is ejected onto the applicator member 3. This makes it possible to avoid adding preservatives to the product compositions or to reduce the proportion thereof.

The rod 2 and the applicator member 3 are not stressed by the effort necessary to eject a dose. Furthermore, the gripping element E remains easy to manipulate, since the body C in which the seating of the applicator member is located is separated from the element E during making-up.

What is claimed is:

1. A distributor for a cosmetic product in fluid or paste form comprising;

a gripping member having a reservoir of the cosmetic product;

a rod with an internal passage extending from said gripping member, said rod having one end of said internal passage in fluid connection with said reservoir to receive the cosmetic product therefrom;

said rod having at least one aperture at the other end of said internal passage through which the cosmetic product flowing in said passage is discharged from said rod;

an applicator member on said rod with said internal passage extending inside said applicator member, said at least one aperture of said internal passage opening on said applicator member to directly feed the cosmetic product on said applicator member; and a distributor body to which said gripping member is detachably mounted for housing said applicator member and the portion of said rod extending from said gripping member.

2. The distributor according to claim 1 wherein said applicator member includes a plurality of holes and said at least one aperture of said internal passage opens at said holes of said applicator member, and wherein said holes are radially oriented distributed around the periphery of said applicator member.

3. The distributor according to claim 2, wherein said applicator member includes four holes spaced 90° from each other.

4. The distributor according to claim 1, wherein said applicator member includes a plurality of holes, and wherein said internal passage at least one aperture opens at said plurality of holes.

5. The distributor according to claim 4, wherein said applicator member includes four holes in communication with said at least one aperture spaced 90° from each other about the periphery of said applicator member.

6. The distributor according to claim 5, wherein said applicator member comprises an externally grooved cylinder.

7. The distributor according to claim 1, wherein said internal passage has a plurality of said apertures radially oriented and regularly distributed around the periphery of said rod.

8. A distributor as in claim 1 wherein said applicator member is a cylinder with a grooved external surface for receiving the cosmetic fed from said internal passage.

9. The distributor according to claim 1 wherein said gripping member is a sealed capsule having a reservoir containing the cosmetic product and a pump for dispensing the cosmetic product from said reservoir into said internal passage.

10. A gripping element for a cosmetic product, comprising:

a capsule having a reservoir of said product;

a rod extending from said capsule, said rod having an internal passage with one end in fluid communication with said reservoir to receive the cosmetic product therefrom;

said rod having at least one aperture through which the cosmetic flowing in said internal passage is discharged;

an applicator member on said rod with said internal passage extending inside said applicator member, said at least one aperture of said internal passage opening on said applicator member to directly feed the cosmetic product to said applicator member.

11. The gripping element according to claim 10, further comprising a feed means on said capsule for feeding the cosmetic product from said reservoir to said internal passage.

12. The gripping element according to claim 11, wherein said internal passage opens at a part of said applicator member having at least one hole radially oriented on the periphery of said applicator member.

13. A gripping element as in claim 10 wherein a portion of said applicator member overlies said at least one aperture of said internal passage.

14. A gripping element as in claim 13 wherein said applicator member is a cylinder with a grooved external surface for receiving the cosmetic feed from said internal passage.

* * * * *